US005625369A

United States Patent [19]

Newman

[11] Patent Number: 5,625,369

[45] Date of Patent: Apr. 29, 1997

[54] GRAPHIC-DISPLAY PANEL ANTENNAS

[75] Inventor: Edward M. Newman, Nesconset, N.Y.

[73] Assignee: Hazeltine Corporation, Greenlawn, N.Y.

[21] Appl. No.: 203,200

[22] Filed: Feb. 28, 1994

[51] Int. Cl.[6] ..... H01Q 13/10; H01Q 1/42

[52] U.S. Cl. ..... 343/770; 343/872

[58] Field of Search ..... 343/770, 720, 343/872, 873, 713, 771, 700 MS; H01Q 13/10, 1/42

[56] References Cited

U.S. PATENT DOCUMENTS

| | | | |
|---|---|---|---|
| 4,914,448 | 4/1990 | Otsuka et al. | 343/700 MS |
| 5,181,042 | 1/1993 | Kaise et al. | 343/700 MS |

FOREIGN PATENT DOCUMENTS

| | | | |
|---|---|---|---|
| 5-83022 | 4/1993 | Japan | H01Q 1/42 |
| 2234117 | 1/1991 | United Kingdom | H01Q 1/42 |
| 2246242 | 1/1992 | United Kingdom | H01Q 1/42 |

*Primary Examiner*—Hoanganh T. Le

*Attorney, Agent, or Firm*—Edward A. Onders; Kenneth P. Robinson

[57] ABSTRACT

Thin panel antennas, suitable for mounting on the side of a building, display a graphic representation and coloration compatible with the surface form and coloration of the building. A graphic display structure functions as a radome covering the front of an antenna utilizing slot arrays or other radiating elements. The graphic representation positioned on such display structure provides an image and coloration which may simulate the surface form and coloration of the building, simulate a structural feature, or otherwise provide a compatible visual relationship with a building or other structure.

10 Claims, 3 Drawing Sheets

GRAPHIC-DISPLAY PANEL ANTENNAS

This invention relates to antennas designed to be coordinated with their surroundings and, more particularly, to graphic-display panel antennas providing a graphic representation having a compatible visual relationship with the surface of a structure upon which the antenna is to be mounted.

BACKGROUND OF THE INVENTION

There is a growing demand for installation of antennas in urban and other areas in order to support cellular telephone and other types of wireless communication services. In cities, in particular, there is resistance to the granting of permission to mount additional antennas on buildings because of the effect of the antennas and associated support towers on the overall appearance of a building. This reflects the fact that most prior antennas, while intended to achieve desired electrical performance, have not been designed to be either visually inconspicuous or visually coordinated with the buildings or other structures upon which the antennas are to be mounted.

It is an object of this invention, therefore, to provide new and improved types of antennas, including thin panel antennas which can be mounted flat against the side of a structure and which include a graphic representation or coloration.

A further object is to provide such antennas which incorporate a graphic representation with predetermined coloration having a compatible visual relationship to the surface form and coloration of a portion of a building or other structural mounting site.

SUMMARY OF THE INVENTION

In accordance with the invention, a graphic-display slot panel antenna, a thickness on the order of three inches and suitable for mounting in relation to a structure with predetermined surface form and coloration, includes a plurality of vertically-arrayed horizontal slot radiating elements formed in a first conductive sheet. Excitation means, including signal coupling portions positioned in spaced relation to the back of the first conductive sheet and extending across the slot radiating elements, is arranged for providing slot excitation. A second conductive sheet extends at least partially coextensively with the back of the first conductive sheet, in spaced relation to the excitation means. Graphic display means, formed of radiation transmissive material and positioned in spaced relation to the front of the first conductive sheet, is provided for supporting on an outward-facing portion of the graphic display means a graphic representation. A graphic representation with predetermined coloration is positioned on the graphic display means and has a compatible visual relationship to the surface and coloration of the structure on which the antenna is to be mounted. The antenna also includes coupling means for enabling signals to be coupled to and from the excitation means for transmission and reception by the antenna as selected in particular application. As so constituted, the antenna may then be positioned in relation to such structure to permit viewing of the visual relationship.

For a better understanding of the invention, together with other and further objects, reference is made to the following description taken in conjunction with the accompanying drawings and the scope of the invention will be pointed out in the accompanying claims.

DESCRIPTION OF THE INVENTION

Figure 1:
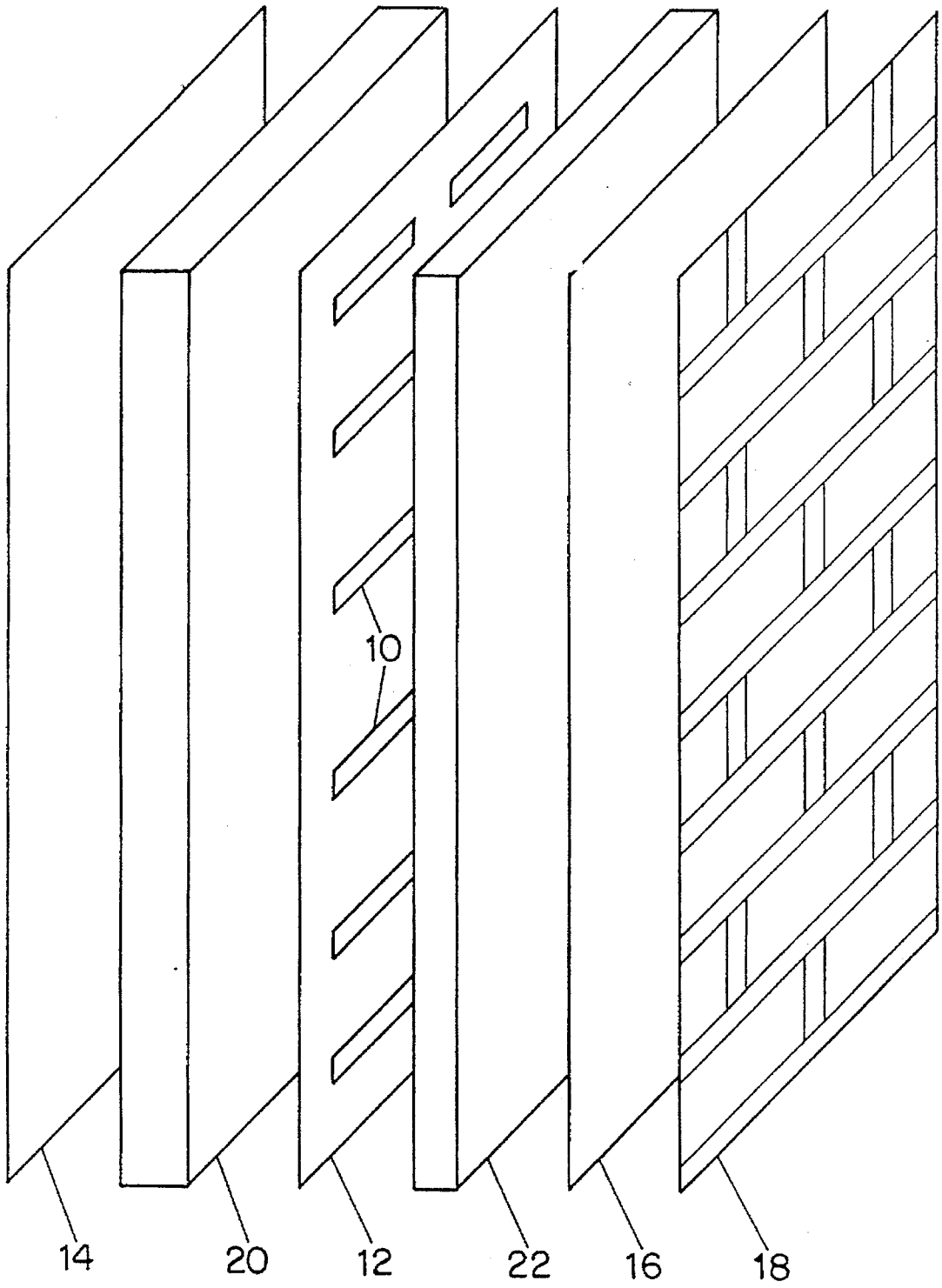
FIG. 1 is an exploded orthogonal view of a graphic-display slot panel antenna in accordance with the invention.
Figure 2A:
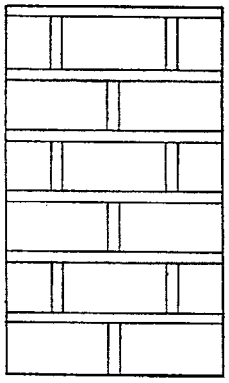
FIGS. 2*a*, 2*b*, 2*c* and 2*d* are front views of assembled antennas including different graphic representations.
Figure 2B:
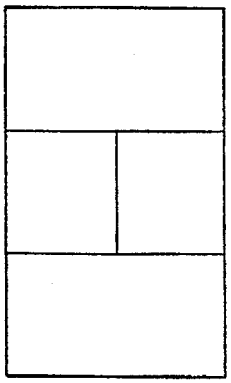
Figure 2C:
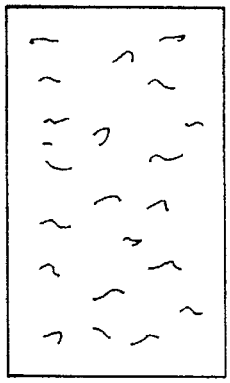
Figure 2D:
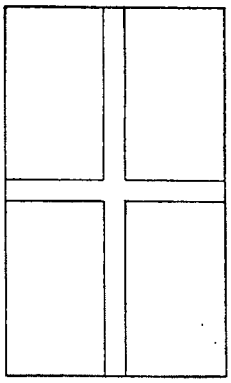

Referring now to FIG. 1 there is illustrated a simplified exploded orthogonal view of a graphic-display slot panel antenna utilizing the invention. As shown, a plurality of vertically-arrayed horizontal slot radiating elements 10 are formed in a first conductive sheet 12. Sheet 12 may typically be a flat portion of a sheet of aluminum with the slots 10 punched in it or an etched copper layer on a printed circuit substrate. The FIG. 1 antenna also includes excitation means for providing slot excitation. The excitation means, which typically include signal coupling portions spaced from the back of sheet 12 and extending across each slot 12, are not visible in the simplified FIG. 1 view but will be discussed further below. A second conductive sheet 14 extends coextensively with sheet 12 in spaced relation to the excitation means behind sheet 12. Sheet 14 is typically a flat portion of a sheet of aluminum.

The FIG. 1 antenna also includes graphic display means 16 for supporting on an outward-facing portion thereof a graphic representation, and a graphic representation 18 with predetermined coloration positioned on the outward-facing portion of the graphic display means 16. As represented in FIG. 1, the graphic representation 18 resembles a portion of a brick wall and will be understood to incorporate predetermined coloration, e.g., reddish bricks and sand colored grouting. Graphic display means 16 may be in the form of a sheet of radiation transmissive weather resistant material, such as an appropriate dielectric, in sheet form or shaped as a protective radome. Graphic representation 18 may comprise a decorative colored image painted, screened or otherwise placed directly on the outside surface of graphic display means 16 or on a sheet of vinyl or other suitable weather resistant material which is glued or otherwise fixed to the outside surface of graphic display means 16. A graphic representation of bricks, for example, may achieve a further improved visual effect by providing a three-dimensional display with limited grout indentations.

Thus, the FIG. 1 antenna represents an antenna adapted for mounting on the wall of a structure having an outer facade of brick with predetermined surface form and coloration. Accordingly, the graphic representation 18 is arranged to resemble the brick facade in surface form and coloration so as to provide a compatible visual relationship. The objective being to provide a graphic representation and coloration 18 positioned on the graphic display means 16 which will visually blend when the antenna is mounted on the brick facade, so that the antenna will not be visually offensive and may approach inconspicuousness or invisibility when viewed from a distance. While this example addresses an antenna for mounting on a brick wall, it will be apparent that in other installations the graphic representation 18 can be provided to resemble a stone block facade, stucco, marble, concrete, etc., or a window or other structural feature. Alternatively, the preselected visual relationship may involve contrasting texture or coloration and may include letters, characters or symbols in order to achieve a desired effect. Typical graphic representations are illustrated in FIGS. 2*a–d*. Many other graphic representations may be used to provide visual relationships having any desired compatible effect.

Figure 3:
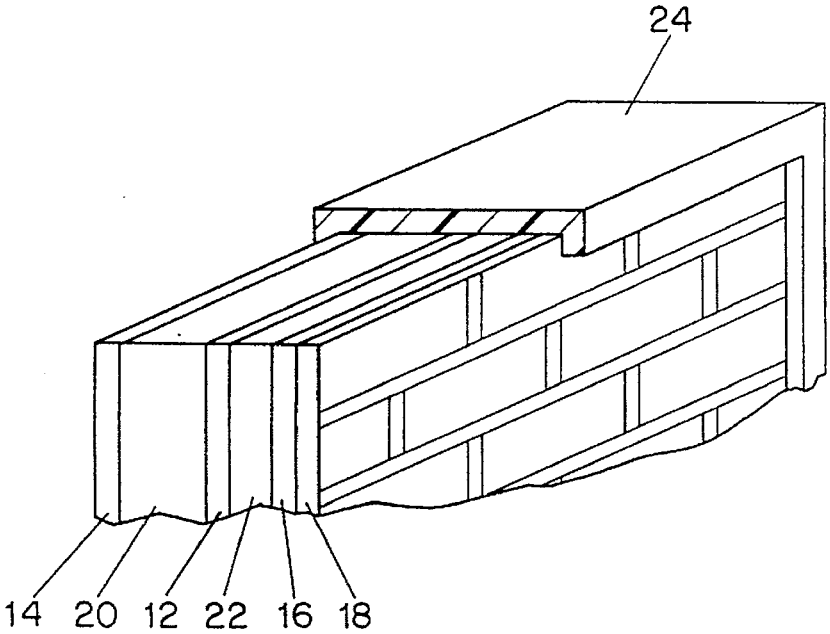
FIG. 3 is a partial view of the FIG. 1 antenna assembled.

The antenna also includes coupling means as described below and means for positioning elements of the antenna in spaced relationship. As illustrated in FIG. 1, the means for positioning include forward and rear foam members 20 and 22 of low dielectric constant non-conductive material. The forward portion of sheet 20 may be formed or indented as appropriate to accommodate the excitation means positioned behind conductive sheet 12. The thickness of members 20 and 22 are determined in order to achieve desired antenna performance and such determinations as to foam thickness and effects of foam dielectric properties are within the capabilities of skilled antenna engineers. FIG. 3 shows a portion of the FIG. 1 antenna after assembly by placing elements 14, 20, 12, 22, 16 and 18 in respective contact with each other and installing "U" shaped edge member 24 around the entire edge of the antenna. Edge member 24 may be formed of extruded insulative plastic or other material which is glued, bonded or sealed in place to both provide physical stability and provide a weather resistant seal. Edge member 24 may be of a suitable neutral color or otherwise colored, textured and patterned for desired visual compatibility with graphic representation 18. Members 12, 14, 16 and 18 will each have a finite thickness, which is illustrated in FIG. 3; such thickness is not shown in the simplified view of FIG. 1. Also, certain features are enlarged for clarity and the drawings are not to scale.

Figure 4:
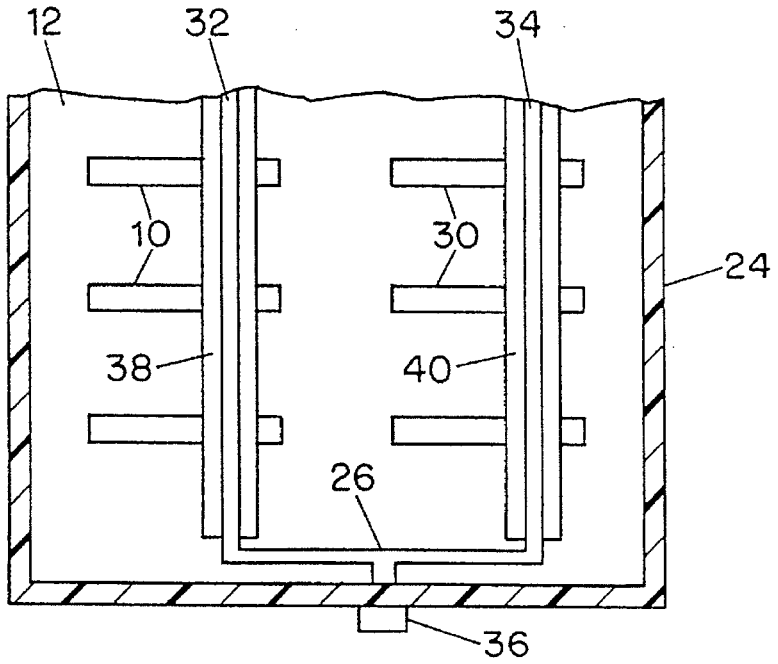
FIG. 4 is a partial rear view of a portion of the FIG. 1 antenna.

With reference now to FIG. 4, there is shown a portion of the back of conductive sheet 12 after the FIG. 1 antenna is cut by a vertical slice through foam member 20 and removal of the remaining portion of foam member 20 to expose the back of sheet 12 and associated excitation means. In FIG. 4 sheet 12 and the cut edge of edge member 24 are visible. Also shown is excitation means 26 for providing slot excitation. Antennas are typically operable for signal reception or transmission, or both, and the phrase "providing slot excitation" encompasses coupling signals to or from slots, or both, as appropriate in particular embodiments. As illustrated, excitation means 26 comprises two vertically positioned conductive line portions respectively crossing the first vertical array of slots 10 and a second similar array of slots 30. The two line portions 32 and 34 are joined at the bottom and connected to an input/output coupler shown as electrical connector 36 which extends through edge member 24. The line portions 32 and 34 are supported in spaced position to the sheet 12 by dielectric support members 38 and 40 which are bonded or otherwise fixed to sheet 12 and may be adapted to partially encompass and physically grasp, or otherwise support, line portions 32 and 34, respectively. Thus, with line portions 32 and 34 provided as conductors of aluminum or other material of circular cross section, support members 38 and 40 may typically be formed of extrusions of polyethylene or other dielectric material having a flat back (in the FIG. 4 orientation) in contact with sheet 12 and a front portion with a front opening. Such a front opening may be a cavity of cross section resembling a portion of a circle sized to accept the conductors 32 and 34 extending somewhat more than 180 degrees around their circumference, so that the conductors are partially surrounded and physically restrained in position.

This feed arrangement provides great simplicity, cost effectiveness and ease of production once an effective design of slot dimensions, slot and feed placement, etc. is provided. In other embodiments of the invention it may be desirable to configure slot radiating elements and related excitation elements on opposite sides of an appropriately etched printed circuit board or in other configurations as available in the prior art. Consistent with well established antenna design considerations, it will be apparent that while FIGS. 1 and 4 show two parallel vertical arrays of slots, in other applications one or more arrays may be provided to meet desired horizontal beamwidth considerations. Also, the number of slots arrayed vertically in each array reflects desired vertical beamwidth considerations. In other embodiments, other types and arrangements of radiating elements may be used.

Figure 5:
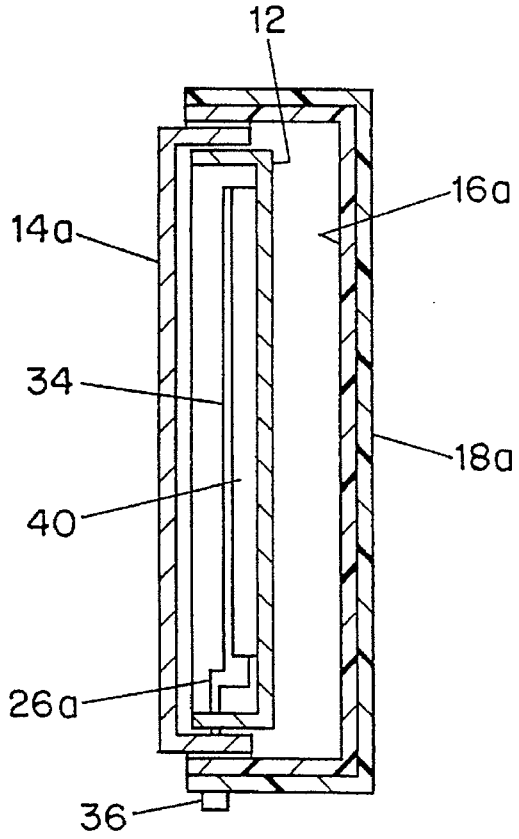
FIG. 5 is a sectional view of an antenna utilizing an alternative construction.

FIG. 5 shows a cross section of an antenna utilizing the invention in an alternative form of construction. In FIG. 5, sheet 14*a* has the form of an aluminum tray with a planar central section surrounded by a perpendicularly extending wall or edge portion about one inch high. Similarly, sheet 12*a*, which includes the slot arrays as in FIG. 1 and supports excitation means as in FIG. 4, has a similar tray form with an edge portion proportioned to fit or nest within the edge portion of member 14*a*. Graphic display means 16*a* has a similarly shaped tray form constructed of radiation transmissive dielectric material. There is a one and one-half to two inch edge portion around member 16*a* which is proportioned to encompass member 14*a* while spacing the front portion of member 16*a* from the slots of member 12*a*. On assembly, member 16*a* can be sealed to back member 14*a* to provide a closed structural assembly with internal air dielectric. A typical dual array antenna for use in cellular telephone applications may be provided in either the FIG. 3 or the FIG. 5 types of construction, with dimensions of the order of 16 inches wide by 54 inches high by 3 inches thick. Wider or narrower horizontal beamwidth antennas utilizing a single array or four arrays of slots, for example, have widths which vary accordingly.

It will thus be appreciated that antennas utilizing the invention are capable of providing high performance electrical characteristics, while achieving a desired visual appearance, such as very low visual discernability from a distance or desired contrast to a building facade. Prior types of antennas are typically mounted with a downward physical tilt of the entire antenna in order to provide a downward squint or beam tilt. With the present invention such squint can readily be provided by proper design and spacing of the slots, which are then merely punched out in the proper configuration and assembled into antennas providing the desired degree of squint. In other applications, once the invention is understood, known antenna design. principles may be employed to utilize dipoles, patches or other elements, or to provide crossed slots for duplex operation using two linear polarizations or dual circular polarizations.

While there have been described the currently preferred embodiments of the invention, those skilled in the art will recognize that other and further modifications may be made without departing from the invention and it is intended to claim all modifications and variations as fall within the scope of the invention.

What is claimed is:

1. A graphic-display slot panel antenna, of thin construction relative to width and height and suitable for mounting to a wall of a structure with predetermined surface form and coloration, comprising:

a plurality of vertically-arrayed horizontal slot radiating elements formed in a first conductive sheet;

excitation means, including signal coupling portions positioned in spaced relation to the back of said first conductive sheet and extending across said slot radiating elements, for providing slot excitation;

a second conductive sheet extending at least partially coextensively with said back of said first conductive sheet and in spaced relation to said excitation means and including a substantially flat panel arranged for mounting contiguous to said wall;

graphic display means, comprising a radome formed of radiation transmissive material and positioned in spaced relation to the front of said first conductive sheet, for supporting a graphic representation on an outward-facing portion of said graphic display means;

a graphic representation with predetermined coloration positioned on said graphic display means and having a compatible visual relationship to said surface form and coloration of said structure; and coupling means for enabling signals to be coupled to and from said excitation means;

whereby positioning of said antenna in relation to said structure permits viewing of said visual relationship.

2. A graphic-display slot panel antenna as in claim 1, wherein said slot radiating elements and excitation means are proportioned and arranged to provide an antenna beam pattern suitable for use in a cellular communication system.

3. A graphic-display slot panel antenna as in claim 1, wherein the thickness and spacing of said first and second conductive sheets and said graphic display means are such that said antenna has a thickness of less than three inches.

4. A graphic-display panel antenna as in claim 1, wherein said graphic representation comprises a sheet of weather resistant material bearing an image and is fixed to said outward-facing portion of said graphic display means.

5. A graphic-display slot panel antenna as in claim 1, wherein said graphic display means is arranged for supporting a graphic representation with predetermined coloration which simulates the surface form and coloration of a portion of the side of a building to which said antenna is to be mounted.

6. A graphic-display panel antenna, of thin construction relative to width and height and suitable for mounting to a wall of a structure with predetermined surface form and coloration, comprising:

a plurality of radiating elements;

excitation means, including at least one transmission line section, for providing excitation of said radiating elements;

support means for supporting said radiating elements and said excitation means;

graphic display means, comprising a radome formed of radiation transmissive material and positioned in spaced relation to said radiating elements, for supporting a graphic representation on an outward-facing portion of said graphic display means;

a back portion, including a substantially flat panel arranged for mounting contiguous to said wall, for supporting said graphic display means;

a graphic representation with predetermined coloration positioned on said graphic display means and having a compatible visual relationship to said surface form and coloration of said structure; and coupling means for enabling signals to be coupled to and from said excitation means;

whereby positioning of said antenna in relation to said structure permits viewing of said visual relationship.

7. A graphic-display panel antenna as in claim 6, wherein said graphic display means is arranged for supporting a graphic representation with predetermined coloration which simulates the surface form and coloration of a portion of the side of a building to which said antenna is to be mounted.

8. A graphic-display panel antenna as in claim 6, wherein said graphic representation comprises a sheet of weather resistant material bearing an image and is fixed to said outward-facing portion of said graphic display means.

9. A graphic-display panel antenna as in claim 6, wherein the thickness and spacing of said first and second conductive sheets and said graphic display means are such that said antenna has a thickness of less than three inches.

10. A graphic-display panel antenna as in claim 6, wherein said back portion is arranged for mounting in one of the following relationships to said wall of said structure: flat against said wall; closely spaced from and substantially parallel to said wall.

* * * * *